US008876558B2

(12) United States Patent
Lee et al.

(10) Patent No.: US 8,876,558 B2
(45) Date of Patent: Nov. 4, 2014

(54) ELECTRICAL CONNECTOR

(71) Applicant: Power Quotient International Co., Ltd., New Taipei (TW)

(72) Inventors: Charles C Lee, New Taipei (TW); Chia Hsin Tsai, New Taipei (TW); Jen Fu Chen, New Taipei (TW); Yu Cheng Chang, New Taipei (TW)

(73) Assignee: Power Quotient International Co., Ltd., New Taipei (TW)

( * ) Notice: Subject to any disclaimer, the term of this patent is extended or adjusted under 35 U.S.C. 154(b) by 73 days.

(21) Appl. No.: 13/894,585

(22) Filed: May 15, 2013

(65) Prior Publication Data

US 2013/0309907 A1 Nov. 21, 2013

(30) Foreign Application Priority Data

May 16, 2012 (TW) ..... 101209212 U

(51) Int. Cl.

| | |
|---|---|
| ***H01R 24/00*** | (2011.01) |
| ***H01R 13/66*** | (2006.01) |
| ***H01R 12/72*** | (2011.01) |
| *H01R 24/62* | (2011.01) |
| *H01R 27/00* | (2006.01) |

(52) U.S. Cl.

CPC ..... *H01R 13/6658* (2013.01); *H01R 12/725* (2013.01); *H01R 24/62* (2013.01); *H01R 27/00* (2013.01)

USPC ..... 439/660; 439/79

(58) Field of Classification Search

USPC ..... 439/660, 79, 76.1

See application file for complete search history.

(56) References Cited

U.S. PATENT DOCUMENTS

| | | | | |
|---|---|---|---|---|
| 7,850,465 | B1 * | 12/2010 | Wan et al. | 439/79 |
| 8,167,658 | B1 * | 5/2012 | Liu | 439/630 |
| 8,376,785 | B2 * | 2/2013 | Lapidot et al. | 439/660 |

* cited by examiner

*Primary Examiner* — Xuong Chung Trans

(74) *Attorney, Agent, or Firm* — WPAT, PC; Anthony King

(57) ABSTRACT

An electrical connector includes a base board having a plurality of first contact pads and second contact pads exposed on one end of the base board, a plurality of first terminals each having one end thereof connected with the corresponding first contact pad of the base board, a plurality of second terminals each having one end thereof arranged alternately with the first terminals and connected with the corresponding second contact pad of the base board, and an insulating housing having a window. The other end of the first terminal is slanted downward at an angle and then curved upward back to form a barb-like contact portion. The other end of the second terminal defines a contact protrusion. The base board together with the first terminals and the second terminals are disposed in the insulating housing. The contact portions and the contact protrusions are exposed outside through the window.

18 Claims, 7 Drawing Sheets

ELECTRICAL CONNECTOR

BACKGROUND OF THE INVENTION

1. Field of the Invention

The present invention relates to an electrical connector, and more particularly to an electrical connector compatible with the USB (Universal Serial Bus) 2.0 specification and the USB 3.0 specification.

2. The Related Art

Nowadays, with the development of electronic technology, electronic products and peripheral devices thereof are connected with each other more and more frequently. And it is a kind of common connection way to realize an electrical connection between the electronic product and its peripheral device by virtue of an electrical connector. Furthermore, the rapid developments of the electronic technology call for more stringent requirements to signal transmission rate of the electrical connector. So an electrical connector defined by the USB 3.0 specification emerges as the times require. But because USB 2.0 connectors are still the mainstream specification at present, an electrical connector compatible with the USB 2.0 specification and the USB 3.0 specification comes with the tide of fashion.

The conventional electrical connector compatible with the USB 2.0 specification and the USB 3.0 specification generally includes an insulating housing, a plurality of first terminals and a plurality of second terminals disposed in the insulating housing and each having a contact portion. In use, the electrical connector is inserted in a mating connector to realize electrical connection with the mating connector. However, at present, the electrical connector and the mating connector often have a reverse contact between a part of the contact portions and corresponding mating terminals of the mating connector. As a result, the contact portions of some of the terminals are easily curled and extruded to deform in the process of mating with the mating connector.

SUMMARY OF THE INVENTION

It is an object of the present invention to provide an electrical connector. The electrical connector includes a base board having a plurality of first contact pads and a plurality of second contact pads embedded and exposed on one end of the base board, a plurality of first terminals each having one end thereof connected with the corresponding first contact pad of the base board, a plurality of second terminals each having one end thereof arranged alternately with the first terminals and connected with the corresponding second contact pad of the base board, and an insulating housing having a window. The other end of the first terminal is slanted downward at an angle and then curved upward back to form a barb-like contact portion. The other end of the second terminal defines a contact protrusion. The base board together with the first terminals and the second terminals are disposed in the insulating housing. The contact portions of the first terminals and the contact protrusions of the second terminals are exposed outside through the window.

It is another object of the present invention to provide an electrical connector. The electrical connector includes a base board having a plurality of first contact pads and a plurality of second contact pads embedded and exposed on one end of the base board, a plurality of first terminals each having one end thereof connected with the corresponding first contact pad of the base board and the other end thereof connected with the one end of the first terminal in a slanted step shape, an insulating body with the first terminals being molded therein, a plurality of second terminals and an insulating housing having a window. An opening is opened in the other end of the first terminal. A front edge of the opening apart from the one end of the first terminal extends slantwise upward and rearward and then is curved downward back to form a barb-like contact portion. The insulating body defines a plurality of through slots arranged at regular intervals along a transverse direction and each extending along a front-to-rear direction for receiving and exposing the contact portions of the first terminals. A plurality of separation blocks are protruded on the insulating body and arranged behind the through slots respectively. Each of the second terminals has a front part of one end thereof positioned between adjacent two separation blocks of the insulating body and a rear part of the one end thereof connected with the corresponding second contact pad of the base board. The other end of the second terminal defines a contact protrusion. The insulating body together with the first terminals and the second terminals are assembled in the insulating housing. The contact portions of the first terminals and the contact protrusions of the second terminals are exposed outside through the window.

As described above, the electrical connector in this invention can be compatible with the USB 2.0 specification and the USB 3.0 specification, and meet the requirement of different signal transmission rates. Moreover, the contact portions of the first terminals are of barb-like shape, so that can achieve an orthodromic and smooth contact between the contact portions and corresponding mating terminals of a mating connector, and effectively avoids the contact portions being reversely curled and extruded to deform for further prolonging use life of the electrical connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
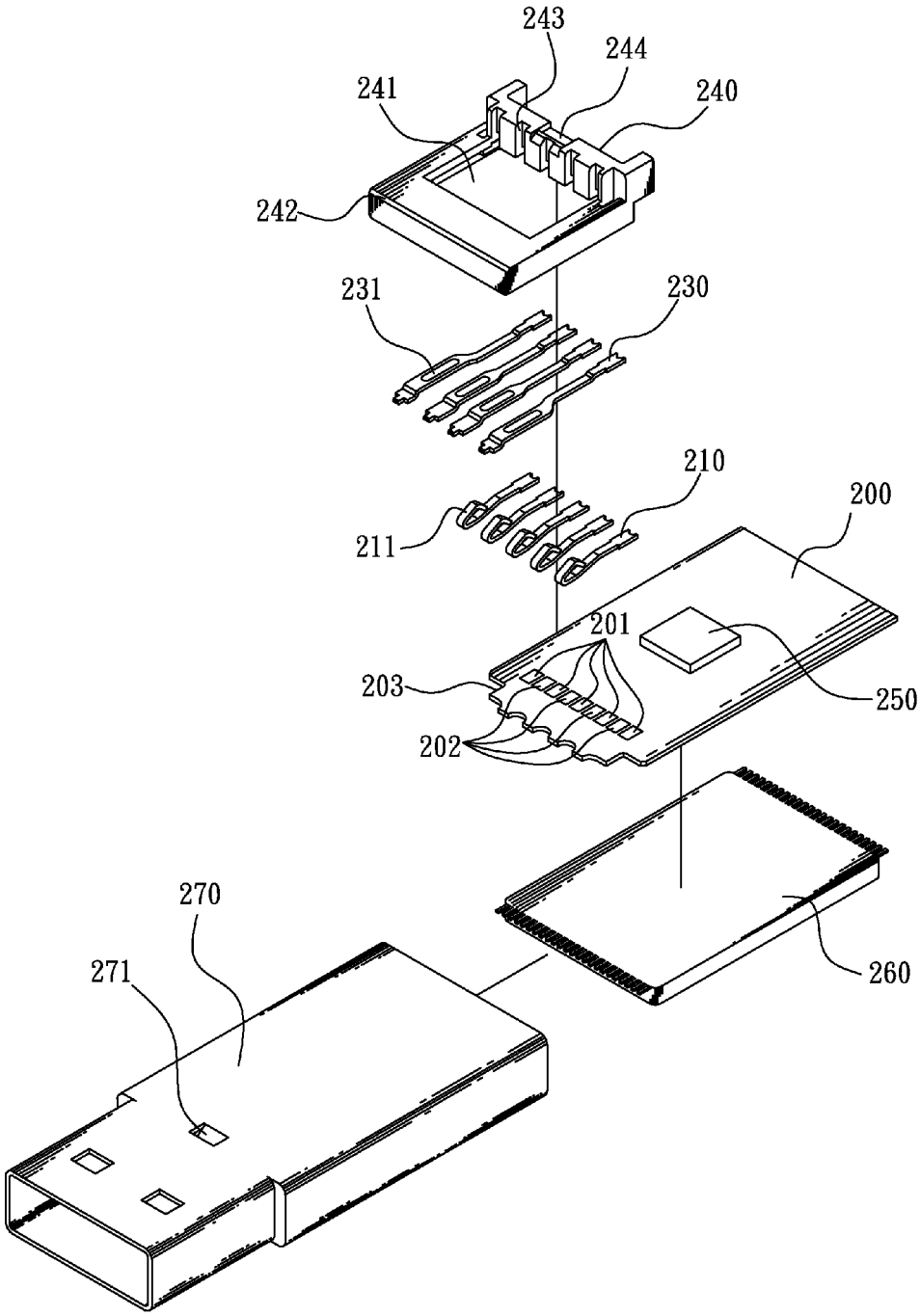
FIG. 1 is an exploded perspective view of an electrical connector in accordance with one embodiment of the present invention.
Figure 2:
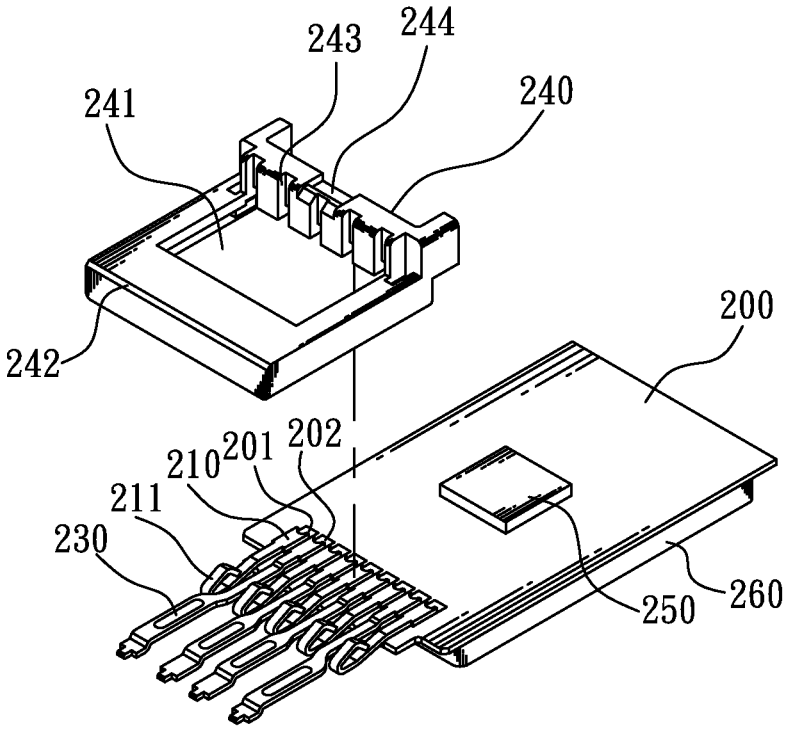
FIG. 2 is a perspective view showing that a plurality of first terminals and a plurality of second terminals are mounted to a base board of the electrical connector of FIG. 1.
Figure 3:
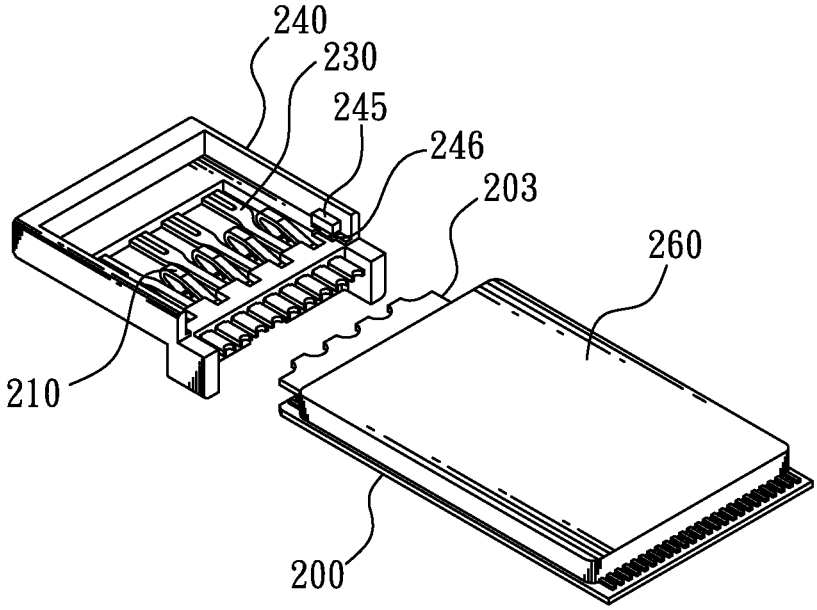
FIG. 3 is a perspective view showing that the base board will be assembled to an insulating housing of the electrical connector of FIG. 1.

Referring to FIGS. 1-5, an electrical connector according to one embodiment of the present invention includes a base board 200, a plurality of first terminals 210, a plurality of second terminals 230 and an insulating housing 240.

The base board 200 is a COB (Chip on Board), a PCB (Printed Circuit Board) or the others. Because the COB has the advantages of thin in depth, compact circuit and small size, it is popular with the package of LCD (Liquid Crystal Display) driver chip or NAND flash. In this embodiment, it takes the COB for example to describe the base board 200.

The base board 200 has a plurality of first contact pads 201 and a plurality of second contact pads 202 embedded and exposed on one end of the base board 200. The first contact pads 201 and the second contact pads 202 are apart arranged in a way of such as but not limited to alternating with one another for electrically soldering with the first terminals 210 and the second terminals 230 respectively. The first contact pads 201 have such as but not limited to five for transmitting the signals in USB 3.0 specification of StdA_SSRX−, StdA_SSRX+, GND_DRAIN, StdA_SSTX− and StdA_SSTX+ respectively. The second contact pads 202 have such as but not limited to four for transmitting the signals in USB 2.0 specification of $V_{BUS}$, D−, D+ and GND respectively.

The first terminals 210 each has one end thereof connected with the corresponding first contact pad 201 of the base board 200. The other end of the first terminal 210 is slanted downward at an angle and then curved upward back to form a barb-like contact portion 211. In this embodiment, the first terminals 210 have such as but not limited to five.

The second terminals 230 each has one end thereof arranged alternately with the first terminals 210 and connected with the corresponding second contact pad 202 of the base board 200. The other end of the second terminal 230 defines a contact protrusion 231 for enhancing an electrical contact thereof. In this embodiment, the second terminals 230 have such as but not limited to four.

The insulating housing 240 has a window 241 for exposing the contact portions 211 of the first terminals 210 and the contact protrusions 231 of the second terminals 230 outside. In detail, the first terminals 210 and the first contact pads 201 of the base board 200 are soldered together and then are assembled in the insulating housing 240 to form a USB 3.0 connector, and the second terminals 230 and the second contact pads 202 of the base board 200 are soldered together and then are assembled in the insulating housing 240 to form a USB 2.0 connector. So the electrical connector in this invention can be compatible with the USB 2.0 specification and the USB 3.0 specification, and meet the requirement of different signal transmission rates.

A front end of the insulating housing 240, namely a mating end, defines a guiding slope 242 at the angle of such as but not limited to 30° relative to the horizontal direction. The insulating housing 240 further defines a plurality of positioning fillisters 243 having the same quantity as the first terminals 210 and arranged on a rear wall of the window 241 in accordance with the first terminals 210 for enlarging the elasticity space for the first terminals 210. A fastening groove 244 is opened on a top of a rear end of the insulating housing 240.

Referring to FIGS. 1-3 again, the base board 200 is further equipped with a USB controller 250 and at least one flash memory 260 coupled with the first contact pads 201 and the second contact pads 202. In this embodiment, the USB controller 250 and the flash memory 260 are packaged on the base board 200 by means of the COB technology. The one end of the base board 200 defined by the contact pads 201, 202 thereon extends forward to form a fastening slice 203. The insulating housing 240 defines two fastening blocks 245 protruded at two sidewalls of a bottom of a rear of the window 241 and spaced under the rear wall of the window 241. Accordingly, an interval 246 is formed between a top of each fastening block 245 and the rear wall of the window 241 for inserting the fastening slice 203 of the base board 200 therein when assembling the base board 200 and the insulating housing 240 together.

Figure 5:
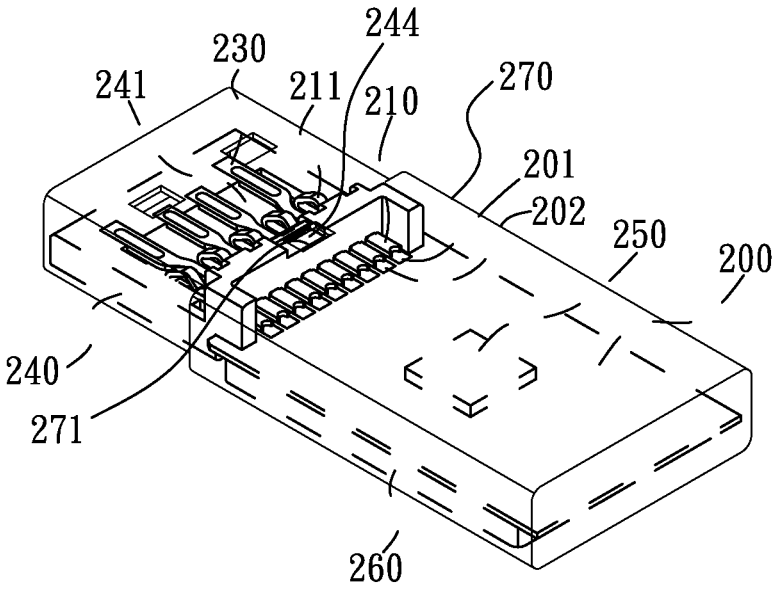
FIG. 5 is an assembled perspective view of the electrical connector of FIG. 1.

Referring to FIG. 1 and FIG. 5, the electrical connector further includes a hollow shielding shell 270 for enclosing the base board 200 and the insulating housing 240 therein. The shielding shell 270 defines a fastening portion 271 at a position corresponding to the fastening groove 244 of the insulating housing 240 for being buckled with the fastening groove 244.

Figure 4:
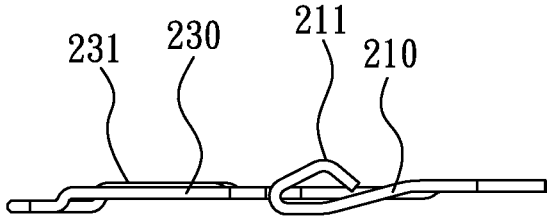
FIG. 4 is a lateral view showing a relative position of the first terminals and the second terminals after they are assembled.

Referring to FIG. 4, in this embodiment, the first terminals 210 and the second terminals 230 are arranged in the same plane after the electrical connector is assembled completely.

Referring to FIGS. 1-5 again, in manufacturing, the first terminals 210 and the second terminals 230 are soldered with the first contact pads 201 and the second contact pads 202 of the base board 200 by the surface mount technology after they are arranged alternately with one another. Then the base board 200 together with the first terminals 210 and the second terminals 230 are disposed in the insulating housing 240 to make the contact portions 211 and the contact protrusions 231 be exposed outside through the window 241, wherein the fastening slice 203 is inserted forward in the intervals 246 to fasten the base board 200 and the insulating housing 240 together. Lastly, the shielding shell 270 is mounted around the insulating housing 240 and the base board 200 to form the electrical connector, wherein the fastening portion 271 is buckled with the fastening groove 244 to ensure the assembly firmly. In use, because the contact portions 211 of the first terminals 210 are of barb-like shape, an orthodromic and smooth contact can be achieved between the contact portions 211 and mating terminals of a mating connector (not shown), so that effectively avoids the contact portions 211 being reversely curled and extruded to deform, and further prolongs use life of the electrical connector.

Referring to FIGS. 6-9, an electrical connector according to another embodiment of the present invention includes a base board 300, a plurality of first terminals 310, an insulating body 320, a plurality of second terminals 330 and an insulating housing 340.

The base board 300 is a COB, a PCB or the others. Because the COB has the advantages of thin in depth, compact circuit and small size, it is popular with the package of LCD driver chip or NAND flash. In this embodiment, take the COB for example to describe the base board 300.

The base board 300 has a plurality of first contact pads 301 and a plurality of second contact pads 302 embedded and exposed on one end of the base board 300. The first contact pads 301 and the second contact pads 302 are apart arranged in a way of such as but not limited to alternating with one another for electrically soldering with the first terminals 310 and the second terminals 330 respectively. The first contact pads 301 have such as but not limited to five for transmitting the signals in USB 3.0 specification of StdA_SSRX−, StdA_SSRX+, GND_DRAIN, StdA_SSTX− and StdA_SSTX+ respectively. The second contact pads 302 have such as but not limited to four for transmitting the signals in USB 2.0 specification of $V_{BUS}$, D−, D+ and GND respectively.

The first terminals 310 each has one end thereof connected with the corresponding first contact pad 301 of the base board 300, and the other end thereof connected with the one end of the first terminal 310 in a slanted step shape. An opening 311 is opened in the other end of the first terminal 310. A front edge of the opening 311 apart from the one end of the first terminal 310 extends slantwise upward and rearward and then is curved downward back to form a barb-like contact portion 312. In this embodiment, the first terminals 310 have such as but not limited to five.

The insulating body 320 is made of such as but not limited to plastics, with the first terminals 310 being molded therein. The insulating body 320 defines a plurality of through slots 321 arranged at regular intervals along a transverse direction and each extending along a front-to-rear direction for receiving and exposing the contact portions 312 of the first terminals 310. A plurality of separation blocks 322 are protruded on the insulating body 320 and arranged behind the through slots 321 respectively. In this embodiment, the through slots 321 and the separation blocks 322 have the same quantity as such as but not limited to five. Besides, two opposite side edges of a front end of the insulating body 320 protrude sideward to form a pair of buckling blocks 323.

The second terminals 330 each has a front part of one end thereof positioned between adjacent two separation blocks 322 of the insulating body 320 and a rear part of the one end thereof connected with the corresponding second contact pad 302 of the base board 300. The other end of the second terminal 330 defines a contact protrusion 331 for enhancing an electrical contact thereof. In this embodiment, the second terminals 330 have such as but not limited to four.

The insulating body 320 together with the first terminals 310 and the second terminals 330 are assembled in the insulating housing 340. The insulating housing 340 has a window 341 for exposing the contact portions 312 of the first terminals 310 and the contact protrusions 331 of the second terminals 330 outside. Two inner sidewalls of a front of the window 341 define two buckling grooves 342 for buckling the buckling blocks 323 of the insulating body 320 therein. The first contact pads 301, the first terminals 310 and the through slots 321 have the same quantity as five and are cooperated to form a USB 3.0 connector. The second contact pads 302 and the second terminals 330 have the same quantity as four and are cooperated to form a USB 2.0 connector. So the electrical connector in this invention can be compatible with the USB 2.0 specification and the USB 3.0 specification, and meet the requirement of different signal transmission rates. A front end of the insulating housing 340, namely a mating end, defines a guiding slope 343 at the angle of such as but not limited to 30° relative to the horizontal direction. A fastening groove 344 is opened on a top of a rear end of the insulating housing 340.

Figure 6:
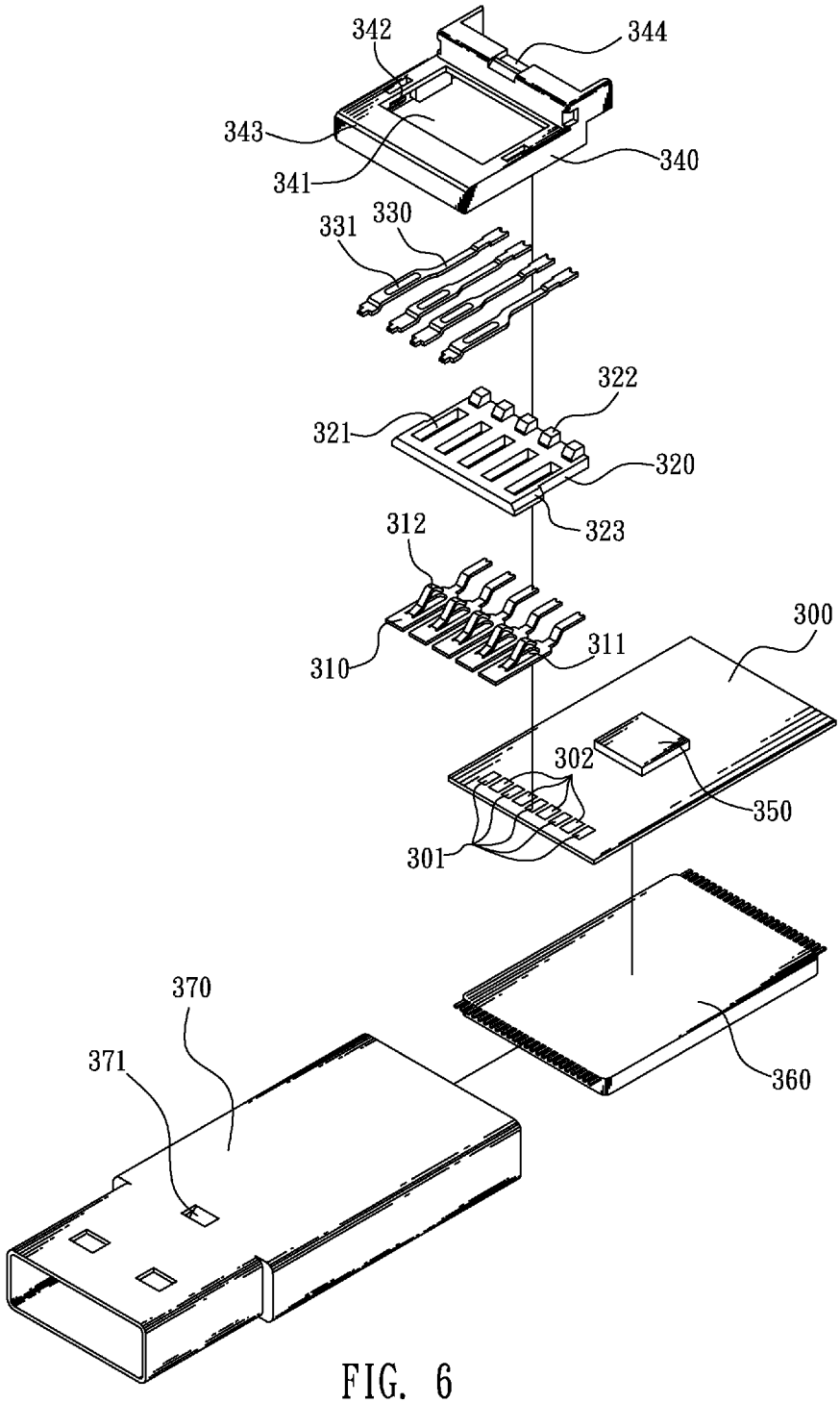
FIG. 6 is an exploded perspective view of an electrical connector in accordance with another embodiment of the present invention.
Figure 7:
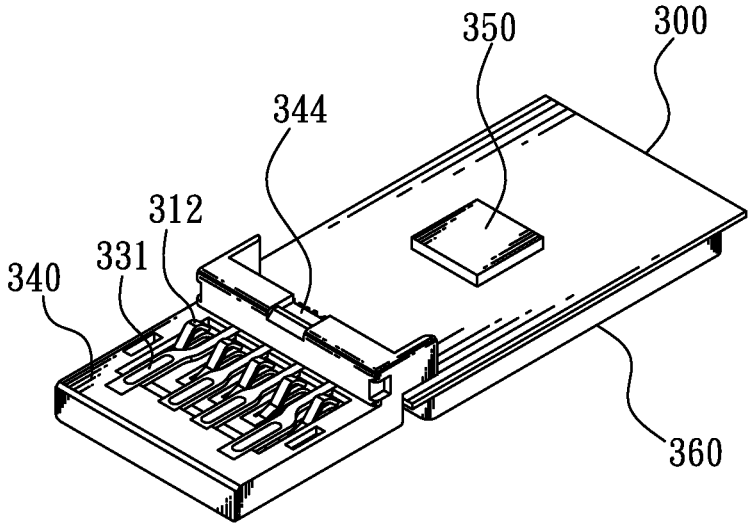
FIG. 7 is an assembled perspective view of the electrical connector of FIG. 6 without a shielding shell.

Referring to FIG. 6 and FIG. 7 again, the base board 300 is further equipped with a USB controller 350 and at least one flash memory 360 coupled with the first contact pads 301 and the second contact pads 302. In this embodiment, the USB controller 350 and the flash memory 360 are packaged on the base board 300 by means of the COB technology.

Figure 9:
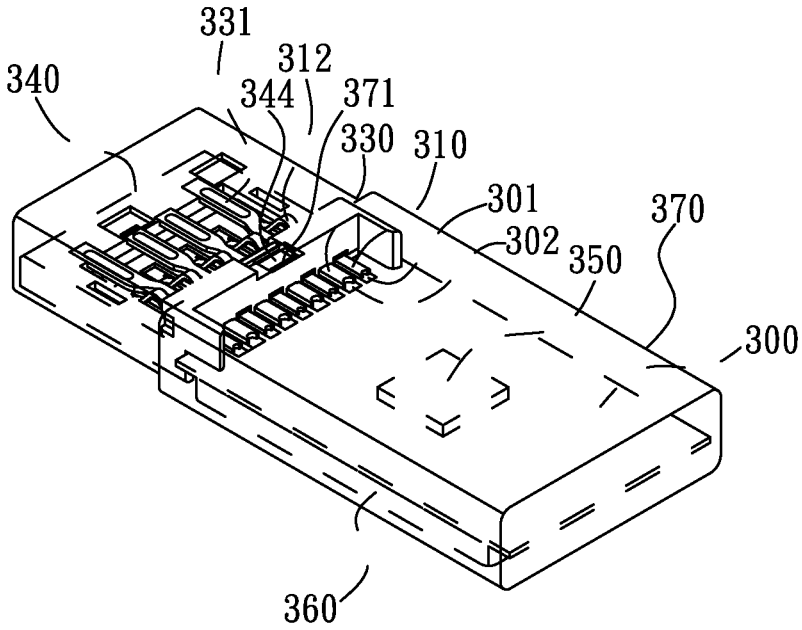
FIG. 9 is an assembled perspective view of the electrical connector of FIG. 6.

Referring to FIG. 6 and FIG. 9, the electrical connector further includes a hollow shielding shell 370 for enclosing the base board 300, the insulating body 320 and the insulating housing 340 therein. The shielding shell 370 defines a fastening portion 371 at a position corresponding to the fastening groove 344 of the insulating housing 340 for being buckled with the fastening groove 344.

Figure 8:
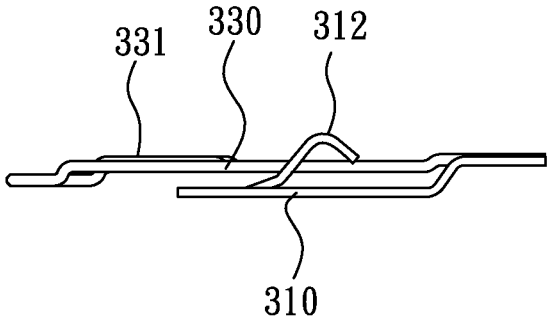
FIG. 8 is a lateral view showing a relative position of first terminals and second terminals of the electrical connector of FIG. 6 after they are assembled.

Referring to FIG. 8, in this embodiment, the first terminals 310 and the second terminals 330 are arranged in different planes after the electrical connector is assembled completely.

Referring to FIGS. 6-9 again, in manufacturing, the first terminals 310 are firstly molded in the insulating body 320 by injection molding and then are soldered with the first contact pads 301 of the base board 300 by the surface mount technology. Then the second terminals 330 are positioned between adjacent two separation blocks 322 of the insulating body 320 respectively in a way of alternating with the first terminals 310, and further are soldered with the second contact pads 302 of the base board 300 by the surface mount technology. Next, the insulating body 320 together with the base board 300, the first terminals 310 and the second terminals 330 are disposed in the insulating housing 340 to make the contact portions 312 and the contact protrusions 331 be exposed outside through the window 341, wherein the buckling blocks 323 are buckled in the buckling grooves 342 to fasten the insulating body 320 and the insulating housing 340 together. Lastly, the shielding shell 370 is mounted around the insulating housing 340, the insulating body 320 and the base board 300 to form the electrical connector, wherein the fastening portion 371 is buckled with the fastening groove 344 to ensure the assembly firmly. In use, because the contact portions 312 of the first terminals 310 are of barb-like shape, an orthodromic and smooth contact can be achieved between the contact portions 312 and mating terminals of a mating connector (not shown), so that effectively avoids the contact portions 312 being reversely curled and extruded to deform, and further prolongs use life of the electrical connector.

As described above, the electrical connector in this invention can be compatible with the USB 2.0 specification and the USB 3.0 specification, and meet the requirement of different signal transmission rates. Moreover, the contact portions 211, 312 of the first terminals 210, 310 are of barb-like shape, so that can achieve an orthodromic and smooth contact between the contact portions 211, 312 and the corresponding mating terminals of the mating connector, and effectively avoids the contact portions 211, 312 being reversely curled and extruded to deform for further prolonging use life of the electrical connector.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector, comprising:

a base board having a plurality of first contact pads and a plurality of second contact pads embedded and exposed on one end of the base board;

a plurality of first terminals each having one end thereof connected with the corresponding first contact pad of the base board, the other end of the first terminal being slanted downward at an angle and then curved upward back to form a barb-like contact portion;

a plurality of second terminals each having one end thereof arranged alternately with the first terminals and connected with the corresponding second contact pad of the base board, the other end of the second terminal defining a contact protrusion; and an insulating housing having a window, the base board together with the first terminals and the second terminals being disposed in the insulating housing, the contact portions of the first terminals and the contact protrusions of the second terminals being exposed outside through the window;

wherein the one end of the base board defined by the contact pads thereon extends forward to form a fastening slice, the insulating housing defines two fastening blocks protruded at two sidewalls of a bottom of a rear of the window and spaced under a rear wall of the window, accordingly, an interval is formed between a top of each fastening block and the rear wall of the window for inserting the fastening slice of the base board therein when assembling the base board and the insulating housing together.

2. The electrical connector as claimed in claim 1, wherein the base board is a COB (Chip on Board) or a PCB (Printed Circuit Board), the first contact pads and the second contact pads are apart arranged in a way of alternating with one another.

3. The electrical connector as claimed in claim 1, wherein the first contact pads and the first terminals have the same quantity as five and are cooperated to form a USB 3.0 connector, the second contact pads and the second terminals have the same quantity as four and are cooperated to form a USB 2.0 connector.

4. The electrical connector as claimed in claim 1, wherein the base board is further equipped with a USB controller and at least one flash memory coupled with the first contact pads and the second contact pads.

5. The electrical connector as claimed in claim 1, wherein the first terminals and the second terminals are soldered with the first contact pads and the second contact pads of the base board by the surface mount technology.

6. The electrical connector as claimed in claim 1, wherein the insulating housing defines a plurality of positioning fillisters having the same quantity as the first terminals and arranged on a rear wall of the window in accordance with the first terminals for enlarging the elasticity space for the first terminals.

7. The electrical connector as claimed in claim 1, wherein a fastening groove is opened on a top of a rear end of the insulating housing, the electrical connector further includes a hollow shielding shell for enclosing the base board and the insulating housing therein, the shielding shell defines a fastening portion at a position corresponding to the fastening groove of the insulating housing for being buckled with the fastening groove.

8. The electrical connector as claimed in claim 1, wherein a front end of the insulating housing defines a guiding slope.

9. The electrical connector as claimed in claim 8, wherein the guiding slope is formed at the angle of 30° relative to the horizontal direction.

10. An electrical connector, comprising:

a base board having a plurality of first contact pads and a plurality of second contact pads embedded and exposed on one end of the base board;

a plurality of first terminals each having one end thereof connected with the corresponding first contact pad of the base board, and the other end thereof connected with the one end of the first terminal in a slanted step shape, an opening being opened in the other end of the first terminal, a front edge of the opening apart from the one end of the first terminal extending slantwise upward and rearward and then being curved downward back to form a barb-like contact portion;

an insulating body with the first terminals being molded therein, the insulating body defining a plurality of through slots arranged at regular intervals along a transverse direction and each extending along a front-to-rear direction for receiving and exposing the contact portions of the first terminals, a plurality of separation blocks being protruded on the insulating body and arranged behind the through slots respectively;

a plurality of second terminals each having a front part of one end thereof positioned between adjacent two separation blocks of the insulating body and a rear part of the one end thereof connected with the corresponding second contact pad of the base board, the other end of the second terminal defining a contact protrusion; and an insulating housing having a window, the insulating body together with the first terminals and the second terminals being assembled in the insulating housing, the contact portions of the first terminals and the contact protrusions of the second terminals being exposed outside through the window.

11. The electrical connector as claimed in claim 10, wherein the base board is a COB (Chip on Board) or a PCB (Printed Circuit Board), the first contact pads and the second contact pads are apart arranged in a way of alternating with one another.

12. The electrical connector as claimed in claim 10, wherein the first contact pads, the first terminals and the through slots have the same quantity as five and are cooperated to form a USB 3.0 connector, the second contact pads and the second terminals have the same quantity as four and are cooperated to form a USB 2.0 connector.

13. The electrical connector as claimed in claim 10, wherein the base board is further equipped with a USB controller and at least one flash memory coupled with the first contact pads and the second contact pads.

14. The electrical connector as claimed in claim 10, wherein the first terminals and the second terminals are soldered with the first contact pads and the second contact pads of the base board by the surface mount technology.

15. The electrical connector as claimed in claim 10, wherein two opposite side edges of a front end of the insulating body protrude sideward to form a pair of buckling blocks, two inner sidewalls of a front of the window define two buckling grooves for buckling the buckling blocks of the insulating body therein.

16. The electrical connector as claimed in claim 10, wherein a fastening groove is opened on a top of a rear end of the insulating housing, the electrical connector further includes a hollow shielding shell for enclosing the base board, the insulating body and the insulating housing therein, the shielding shell defines a fastening portion at a position corresponding to the fastening groove of the insulating housing for being buckled with the fastening groove.

17. The electrical connector as claimed in claim 10, wherein a front end of the insulating housing defines a guiding slope.

18. The electrical connector as claimed in claim 17, wherein the guiding slope is formed at the angle of 30° relative to the horizontal direction.

* * * * *